US008846171B2

(12) United States Patent
Godfrey et al.

(10) Patent No.: US 8,846,171 B2
(45) Date of Patent: Sep. 30, 2014

(54) LABEL MEDIA HAVING A SUBSTRATE AND A TWO-SIDED RELEASABLE LINER

(75) Inventors: Robert J. Godfrey, Baraboo, WI (US); Richard L. Carriere, Oak Creek, WI (US); Edward J. Loeder, West Bend, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 588 days.

(21) Appl. No.: 12/349,079

(22) Filed: Jan. 6, 2009

(65) Prior Publication Data

US 2010/0173103 A1 Jul. 8, 2010

(51) Int. Cl.

| | |
|---|---|
| ***B41M 5/40*** | (2006.01) |
| ***G09F 3/10*** | (2006.01) |
| ***G09F 3/00*** | (2006.01) |
| *G09F 3/02* | (2006.01) |

(52) U.S. Cl.

CPC ..... *G09F 3/10* (2013.01); *G09F 2003/0222* (2013.01); *G09F 2003/0201* (2013.01); *G09F 3/0289* (2013.01)

USPC ..... 428/41.8; 428/121; 428/195.1; 428/200

(58) Field of Classification Search

USPC ..... 428/195.1, 121, 200, 41.8

See application file for complete search history.

(56) References Cited

U.S. PATENT DOCUMENTS

| | | | | |
|---|---|---|---|---|
| 4,032,010 | A | | 6/1977 | Evans |
| 4,363,401 | A | | 12/1982 | Savagian |
| 4,442,939 | A | | 4/1984 | Downing |
| 4,761,086 | A | | 8/1988 | Peterpaul |
| 4,844,629 | A | | 7/1989 | Hoyt |
| 4,865,895 | A | | 9/1989 | Vlamings et al. |
| 4,920,882 | A | | 5/1990 | Hoyt |
| 4,961,666 | A | * | 10/1990 | Pitts et al. ..... 402/79 |
| 5,407,234 | A | * | 4/1995 | Rettker et al. ..... 283/62 |
| 5,766,705 | A | | 6/1998 | O'Brien et al. |
| 5,862,751 | A | | 1/1999 | Triantopoulos et al. |
| 5,996,130 | A | * | 12/1999 | Verhines ..... 40/361 |
| 6,113,293 | A | | 9/2000 | Schanke et al. |
| 6,211,117 | B1 | | 4/2001 | Haggerty et al. |
| 6,532,148 | B2 | | 3/2003 | Jenks et al. |
| 2006/0263564 | A1 | | 11/2006 | Steyaert |

FOREIGN PATENT DOCUMENTS

| | | | |
|---|---|---|---|
| EP | 264959 A | * | 4/1988 |
| EP | 0264959 B1 | | 9/1992 |
| JP | H05124381 A | | 5/1993 |

OTHER PUBLICATIONS

PCT International Search Report, PCT/US2010/020015, May 31, 2010.

Japan Patent Office, Notification of Reason for Refusal, JP 2011-545385 (Corresponding Japanese Patent Application), Jul. 2, 2013, 4 pages.

* cited by examiner

*Primary Examiner* — Gerard Higgins
*Assistant Examiner* — Christopher Polley
(74) *Attorney, Agent, or Firm* — Quarles & Brady LLP

(57) ABSTRACT

Label media for use in a label media printer to form wide labels is disclosed. The label media includes a releasable liner that has a first side and a second side joined by a longitudinal edge. A first side of a substrate adheres to the first and the second sides of the releasable liner. At least a portion of the substrate is ink-receiving.

13 Claims, 2 Drawing Sheets

LABEL MEDIA HAVING A SUBSTRATE AND A TWO-SIDED RELEASABLE LINER

CROSS-REFERENCE TO RELATED APPLICATION

Not applicable.

STATEMENT REGARDING FEDERALLY SPONSORED RESEARCH OR DEVELOPMENT

Not applicable.

FIELD OF THE INVENTION

The present invention relates to print media, and more particularly label media for handheld printers that is carried by a releasable liner.

BACKGROUND OF THE INVENTION

There are a number of U.S. patents that disclose label media useful for marking or identifying objects, such as electrical wires. Some label media designs comprise a series of identical die cut labels that are supported by a releasable liner. The liner is fed through a printer, such as a handheld thermal transfer printer, in a length or "web" direction and indicia is printed on the labels. The liner may include features that interact with a registration system of the printer to control the feed of labels through the printer and appropriately position the labels relative to the print head. After being printed upon and exiting the printer, the labels are removed from the liner and slipped on, or wrapped around, the object to be identified.

There are many combinations of labels and liners that provide labels of different colors, formats and sizes due to the variety of different labeling applications. However, the sizes of label media designs, particularly designs in which the labels are positioned in a "cross-web" direction, are limited by the sizes of appropriate printers. For example, label media that is narrow in the cross-web direction is used with compact handheld printers. That is, compact handheld printers cannot accommodate label media that is wide in the cross-web direction. As a result, compact printer designs often provide labels with few printed characters or indicia that is otherwise difficult to interpret. Further still, in some cases, the area of label media in which indicia may be printed is additionally limited by the presence of an adjacent laminating area that covers the indicia after the label is attached to the object to be identified.

Considering the limitations of previous designs, it would be desirable to have label media that is relatively wide in the cross-web direction and may be used with compact printers.

SUMMARY OF THE INVENTION

The present invention provides label media for use in a label media printer to form relatively wide labels. In some embodiments, the label media includes a releasable liner that has a first side and a second side joined by a longitudinal edge. A first side of a substrate adheres to the first and the second sides of the releasable liner, and at least a portion of the substrate is ink-receiving.

In some embodiments, the label media includes a releasable liner that has a first side and a second side opposite the first side in a thickness direction. The first and second sides are joined by a longitudinal edge. The label media further includes a substrate that has a first adhesive side that adheres to the first and second sides of the releasable liner. The substrate further includes a second side opposite the first adhesive side in the thickness direction. At least a portion of the second side is ink-receiving.

In some embodiments, the label media includes a releasable liner that includes a first side that has a release coating a second side opposite the first side in a thickness direction that also has the release coating. The releasable liner further includes a first longitudinal edge that joins the first and second sides and a second longitudinal edge opposite the first longitudinal edge in a width direction that joins the first and second sides. The label media further includes a substrate that includes a first adhesive side that adheres to the first and second sides of the releasable liner. The substrate further includes a second side opposite the first adhesive side in the thickness direction. At least a portion of the second side is ink-receiving. A fold of the substrate is aligned with the first longitudinal edge of the releasable liner. The substrate further includes a first and second longitudinal edges that join the first adhesive side and the second side of the substrate. The first and second longitudinal edges of the substrate are spaced apart from the second longitudinal edge of the releasable liner.

The foregoing and advantages of the invention will appear from the following description. In the description, reference is made to the accompanying drawings which form a part hereof, and in which there is shown by way of illustration preferred embodiments of the invention. Such embodiments do not necessarily represent the full scope of the invention, however, and reference is made therefore to the claims herein for interpreting the scope of the invention.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
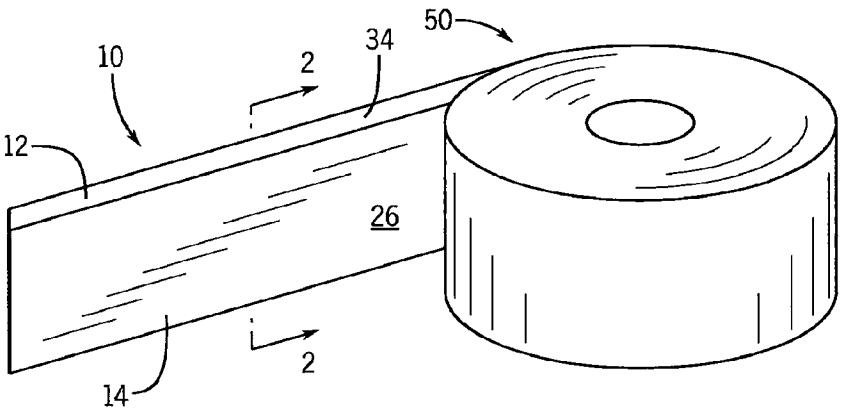
FIG. 1 is a perspective view of a roll of label media of the present invention.
Figure 3:
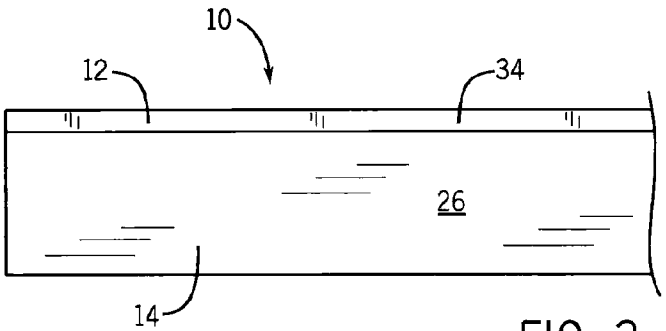
FIG. 3 is a front view of the label media of FIG. 1.
Figure 2:
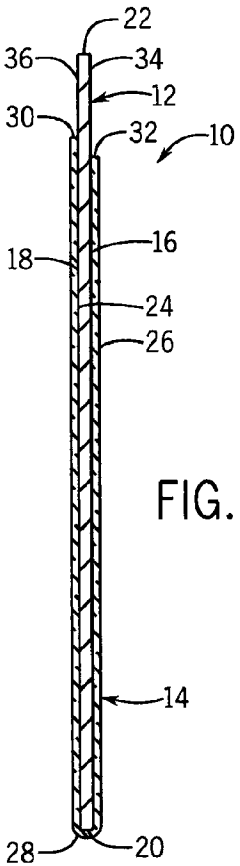
FIG. 2 is a cross-sectional view of the label media along line 2-2 of FIG. 1 and viewed from a length direction of the label media.

Referring to FIGS. 1-3, label media 10 of the present invention includes a releasable liner 12 that supports a substrate 14. The label media 10 is generally elongated in a length or web direction and thin in a thickness direction and, as a result, may be wound along the length direction to provide a roll 50 that is placed within a recess of a printer or attached to a media cartridge for a printer. It should be noted that the structure of the label media 10 is generally uniform in the length direction, although other dimensions of the releasable liner 12 and the substrate 14 vary depending on the specific printing application.

The releasable liner 12 includes a first side 16 and a second side 18 opposite the first side 16 in a thickness direction to which the substrate 14 releasably adheres. As used herein, it should be understood that the term "thickness direction"

refers to a direction perpendicular to the first and second sides 16 and 18. The releasable liner 12 also includes a first longitudinal edge 20 and a second longitudinal edge 22 that join the first and second sides 16 and 18. In the embodiments disclosed herein, the releasable liner 12 may be formed from one or more layers of material, such as paper, cardboard, plastic, and the like, without departing from the scope of the invention. Moreover, the first and second sides 16 and 18 of the releasable liner 12 preferably include a release coating, such as a silicon-based coating, to permit a label to adhere to an object to be identified or the label itself after removal from the releasable liner 12.

In the embodiment shown in FIGS. 1-3, the substrate 14 is generally long and thin. The substrate 14 has a width perpendicular to the length and thickness directions, or a width in the cross-web direction, that is preferably greater than the width of the releasable liner 12 when removed from the liner 12 and positioned flatly. As shown in FIG. 2, the substrate 14 includes a first side 24 and a second side 26 joined by longitudinal edges 30 and 32. An adhesive coating applied to the first side 24 adheres the substrate 14 to the releasable liner 12. The substrate 14 is preferably a thermal transfer tape with an acrylic adhesive, such as Brady® B-427.

In order to provide the label media 10 with an overall width substantially equal to the width of the releasable liner 12 when passing through a printer mechanism of a printer, the substrate 14 folds over and releasably adheres to opposite sides of the releasable liner 12. Specifically, the first adhesive side 24 of the substrate 14 releasably adheres to the first and second sides 16 and 18 of the releasable liner 12. The second side 26 of the substrate 14 includes at least a portion that receives ink from the printer mechanism of the printer. In a preferred embodiment, the substrate 14 includes a fold 28 formed by releasably adhering the first adhesive side 24 to the first and second sides 16 and 18 of the liner 12. The fold 28 is aligned with the first longitudinal edge 20 of the releasable liner 12.

The substrate 14 is easily removed from the releasable liner 12 by spacing at least one longitudinal edge 30, 32 of the substrate 14 from an adjacent edge of the liner 12. In a preferred embodiment, the first longitudinal edge 30 and the second longitudinal edge 32 of the substrate 14 are spaced apart from the second longitudinal edge 22 of the releasable liner 12 in the width direction to provide open surfaces 34 and 36 on the first and second sides 16 and 18 of the liner 12, respectively. The substrate 14 does not adhere to the second longitudinal edge 22 or the open surfaces 34 and 36. Instead, the open surfaces 34 and 36 advantageously permit an operator to locate the longitudinal edges 30 and 32 to remove the substrate 14 from the releasable liner 12.

The substrate 14 may be formed from multiple separate layers of different materials without departing from the scope of the invention. For example, in a second embodiment shown in FIGS. 4-6, label media 110 includes a releasable liner 112 as described above that supports a substrate 114 including materials to permit lamination of the label media 110. A first material 115 of the substrate 114 is clear or otherwise permits indicia printed on an ink receiving material 117 of the substrate 114 to be viewed through the first material 115. That is, the first material 115 may be positioned to cover and laminate the ink receiving material 117 after a portion of the substrate 114 is removed from the releasable liner 112.

A first adhesive side 124 of the first material 115 releasably adheres to the first and second sides 116 and 118 of the releasable liner 112. A portion of a second side 126 of the first material 115 opposite the first adhesive side 124 in the thickness direction aggressively adheres to a first side 127 of the ink receiving material 117. The first material 115 includes a fold 128 formed by releasably adhering the first adhesive side 124 to the first and second sides 116 and 118 of the liner 112. The fold 128 is aligned with the first longitudinal edge 120 of the releasable liner 112. A first longitudinal edge 130 and a second longitudinal edge 132 of the first material 115 that join the first and second sides 124 and 126 are spaced apart from the second longitudinal edge 122 of the releasable liner 112 in the width direction to provide open surfaces 134 and 136 as described above. The first material 115 may be made of a plastic or other appropriate laminating materials. However, other appropriate materials recognized by those skilled in the art may be used without departing from the scope of the invention.

Figure 4:
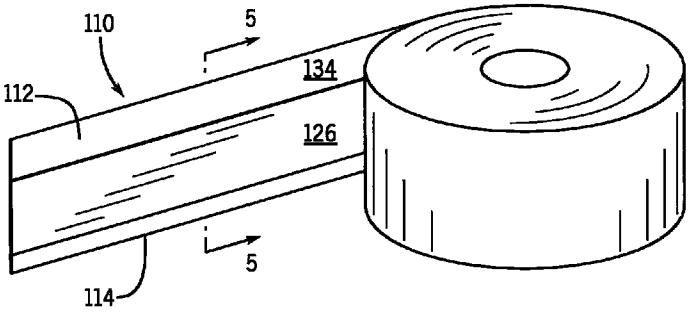
FIG. 4 is a perspective view of a roll of a second embodiment of label media of the present invention.
Figure 6:
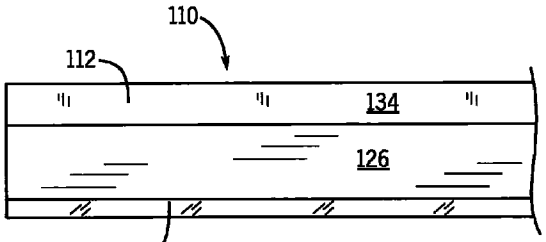
FIG. 6 is a front view of the label media of FIG. 4.
Figure 5:
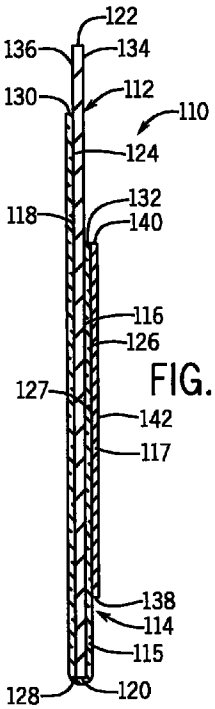
FIG. 5 is a cross-sectional view of the label media along line 5-5 of FIG. 4 and viewed from a length direction of the label media.

In the embodiment disclosed in FIGS. 4-6, the ink receiving material 117 is less wide than the first material 115. That is, a first longitudinal edge 138 of the ink receiving material 117 is spaced apart from the first longitudinal edge 120 of the liner 112 and the fold 128 in the width direction, and a second longitudinal edge 140 of the ink receiving material 117 opposite the first longitudinal edge 138 is aligned with the second longitudinal edge 132 of the first material 115. A second side 142 of the ink receiving material 117 opposite the first side 127 in the thickness direction receives ink from the printer mechanism of the printer. Regarding materials, the ink receiving material 117 may be made from one or more layers of material, such as paper, plastic, and the like. Alternatively, the substrate 114 may be a thermal transfer tape having both translucent and opaque layers, such as Brady® B-427.

From the above discussion it should be apparent that the present invention advantageously provides wide label media in a compact form. As a result, the label media may be printed upon to include many characters or indicia that is easy to interpret compared to previous designs. In addition, in some embodiments, the label media includes a wide area to be printed upon as well as a laminating material to protect the printed area.

The label media of the present invention is particularly suitable for use with handheld printers in which narrow label media permits relatively compact printer housings. However, the label media of the present invention may also may be used with other types of printers, such as tabletop printers. Appropriate printers include components such as a printer mechanism for printing indicia on the label media, means for feeding the label media to be printed past the printer mechanism, a cutting assembly for separating portions of the label media that have been printed upon from the roll, and electronic components, such as a microprocessor, for controlling the aforementioned components. Appropriate printers may include a keyboard with letter, number, and function keys for entry of alphanumeric information and instructions concerning the indicia to be printed, and a visual display unit to assist the operator in using the printer. However, appropriate printers preferably do not have a registration system so that labels may be provided with various lengths.

While there has been shown and described what is at present considered the preferred embodiment of the invention, it will be obvious to those skilled in the art that various changes and modifications can be made therein without departing from the scope of the invention defined by the appended claims.

We claim:

1. Label media comprising:

a releasable liner having a first side spaced apart from a second side in a thickness direction, said first side and said second side joined by a first longitudinal edge, and said releasable liner having a width perpendicular to said thickness direction;

a substrate having a first side adhering to said first and said second side of said releasable liner by folding over said first longitudinal edge, at least a portion of a second side of said substrate being ink-receiving, said substrate having a width parallel to said width of said releasable liner, and said width of said substrate is greater than said width of said releasable liner when said substrate is removed from said releasable liner and unfolded; and wherein said substrate and said releasable liner together extend in a length direction perpendicular to said thickness direction and said width of said releasable liner and said substrate, and said substrate and said releasable liner are together wound in said length direction to define a roll.

2. The label media as in claim 1, in which said substrate includes a first material having said first side of said substrate and a second side, said first side of said first material adhering to said first and said second side of said releasable liner, and an ink receiving material adhering to said second side of said first material.

3. The label media as in claim 2, in which said first material is clear, wherein ink printed on said ink receiving material is viewable through said first material when said label media is affixed to an object and said first material covers said ink printed on said ink receiving material.

4. The label media as in claim 2, in which said releasable liner includes a second longitudinal edge, said first material includes first and second longitudinal edges spaced from said second longitudinal edge of said releasable liner, said ink receiving material includes a longitudinal edge, and said longitudinal edge of said ink receiving material is aligned with said second longitudinal edge of said first material.

5. The label media as in claim 1, in which said releasable liner includes a second longitudinal edge, and said substrate includes first and second longitudinal edges spaced from said second longitudinal edge of said releasable liner.

6. The label media as in claim 1, in which said substrate is thermal transfer tape.

7. Label media comprising:

a releasable liner having a first side and a second side opposite said first side in a thickness direction, said first and said second side being joined by a longitudinal edge and both having a release coating;

a substrate having a first adhesive side releasably adhering to said release coating of said first and said second side of said releasable liner, a second side opposite said first adhesive side in said thickness direction, and at least a portion of said second side being ink-receiving; and wherein said substrate has a width and said releasable liner has a width, wherein said width of said substrate is greater than said width of said releasable liner when said substrate is removed from said releasable liner and positioned flatly.

8. The label media as in claim 7, in which said substrate includes a fold aligned with said longitudinal edge.

9. The label media as in claim 7, in which said releasable liner includes a second longitudinal edge, and said substrate includes first and second longitudinal edges spaced from said second longitudinal edge of said releasable liner.

10. The label media as in claim 7, in which said substrate is thermal transfer tape.

11. Label media comprising:

a releasable liner including:

a first side having a release coating;

a second side opposite said first side in a thickness direction and having said release coating;

a first longitudinal edge joining said first and said second side;

a second longitudinal edge opposite said first longitudinal edge in a width direction and joining said first and said second side;

a substrate including:

a first adhesive side adhering to said first and said second side of said releasable liner;

a second side opposite said first adhesive side in said thickness direction, at least a portion of said second side being ink-receiving;

a fold aligned with said first longitudinal edge of said releasable liner; and first and second longitudinal edges joining said first adhesive side and said second side of said substrate, and said first and second longitudinal edges of said substrate being spaced from said second longitudinal edge of said releasable liner; and wherein said substrate has a width and said releasable liner has a width, wherein said width of said substrate is greater than said width of said releasable liner when said substrate is removed from said releasable liner and positioned flatly.

12. The label media as in claim 11, in which said substrate is thermal transfer tape.

13. Label media comprising:

a releasable liner including:

a first side having a release coating;

a second side opposite said first side in a thickness direction and having said release coating;

a first longitudinal edge joining said first and said second side;

a second longitudinal edge opposite said first longitudinal edge in a width direction and joining said first and said second side;

a substrate including:

a first adhesive side adhering to said first and said second side of said releasable liner;

a second side opposite said first adhesive side in said thickness direction, at least a portion of said second side being ink-receiving;

a fold aligned with said first longitudinal edge of said releasable liner; and first and second longitudinal edges joining said first adhesive side and said second side of said substrate, and said first and second longitudinal edges of said substrate being spaced from said second longitudinal edge of said releasable liner;

wherein said substrate includes a first material having a first adhesive side and a second side, said first adhesive side of said first material adhering to said first and said second side of said releasable liner, and an ink receiving material adhering to said second side of said first material; and wherein said first material is clear, wherein ink printed on said ink receiving material is viewable through said first material when said label media is affixed to an object and said first material covers said ink printed on said ink receiving material.

* * * * *